United States Patent [19]

Mount, II

[11] Patent Number: 4,461,360

[45] Date of Patent: Jul. 24, 1984

[54] BIT EXTENSION GUIDE FOR SIDEWALL CORER

[75] Inventor: Houston B. Mount, II, Tulsa, Okla.

[73] Assignee: Standard Oil Company, Chicago, Ill.

[21] Appl. No.: 426,305

[22] Filed: Sep. 29, 1982

Related U.S. Application Data

[63] Continuation-in-part of Ser. No. 356,613, Mar. 9, 1982, abandoned.

[51] Int. Cl.[3] ..... E21B 49/06

[52] U.S. Cl. ..... 175/78; 175/58; 175/77

[58] Field of Search ..... 175/78, 58, 77, 311, 175/313; 73/864.45

[56] References Cited

U.S. PATENT DOCUMENTS 2,198,821 4/1940 Jessup ..... 175/77

4,396,074 8/1983 Jageler et al. ..... 175/78

*Primary Examiner*—Ernest R. Purser

*Assistant Examiner*—Thuy M. Bui

*Attorney, Agent, or Firm*—John D. Gassett

[57] ABSTRACT

An apparatus for drilling a sidewall core from a borehole which has a cylindrical housing with an opening through which a core bit and barrel are extended and retracted. In a preferred embodiment there is a fixed plate on opposite sides of the bit motor with guide slots cut therethrough. A drive plate is provided adjacent each fixed plate having guide slots. The bit motor has two pins on each side which extend through the guide slots of the drive plate. Movement of the drive plates causes the bit motor to follow the designated path.

10 Claims, 34 Drawing Figures

FIG. 16A
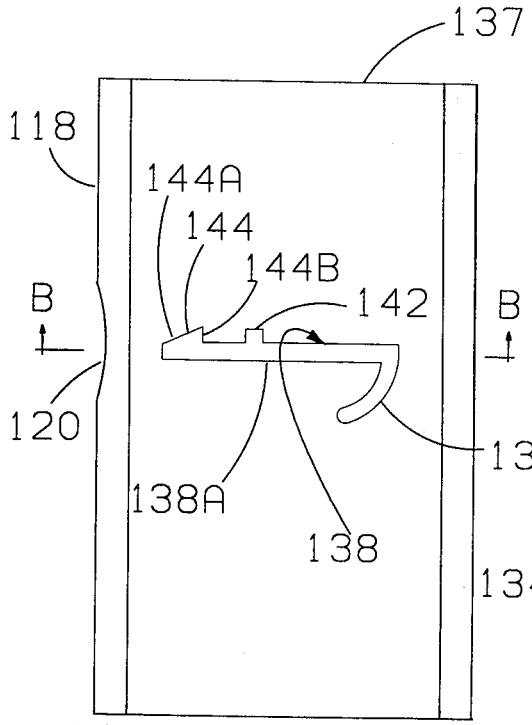
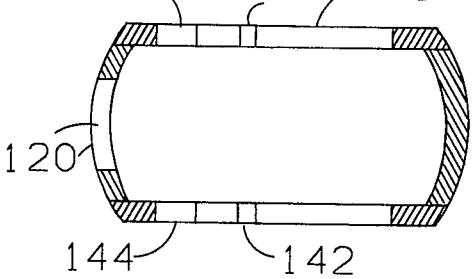
FIG. 16B
FIG. 17A
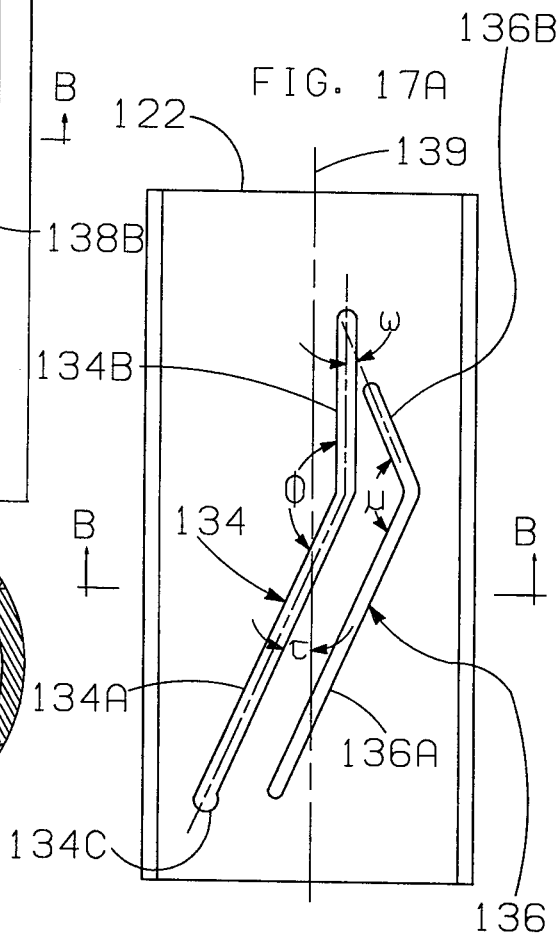
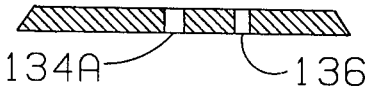
FIG. 17B

BIT EXTENSION GUIDE FOR SIDEWALL CORER

This application is a continuation in part of application Ser. No. 356,613 filed Mar. 9, 1982, now abandoned.

RELATED APPLICATIONS

This application is related to copending application Ser. No. 321,655, filed Nov. 16, 1981, entitled "Drill Bit Extension for Sidewall Corer" for A. H. Jageler, et al. now U.S. Pat. No. 4,396,074.

BACKGROUND OF THE INVENTION

This invention relates to sidewall coring tools. In determining the physical properties of subterranean formations, it is of great assistance to have what is commonly called cores. A core is typically a cylindrical piece of the rock which has been cut from the underground formation and can vary in size and length. A typical size is ½" in diameter and 4" to 6" long; although samples can be of larger diameter and of greater length, depending upon the facilities available. One type of core cutter is the type that can be used to cut the cores from the sidewall of a borehole after the borehole has already been drilled. Such a sidewall coring tool is described in U.S. Pat. No. 4,280,569, issued July 28, 1981, to Houston B. Mount, II, inventor; and Standard Oil Company (Indiana), assignee. This invention relates to such a sidewall coring tool.

BRIEF DESCRIPTION OF THE INVENTION

This invention relates to an apparatus for use in cutting a sidewall core in a borehole drilled in the earth; this includes an elongated frame in a housing (usually cylindrical) which supports a guide means along which the drill bit and motor can be moved to extend and retract the cutting bit and core barrel along a selected path through an opening in the housing. The guide means has a rotation control section and a transverse control section. The rotation control section causes the motor and its core barrel to move from an upright position within the housing to an angle with the vertical and a transverse guide section guiding the coring bit means as it is extended against the formation. The guide means includes a pair of movable guide plates supported by the frame on opposite sides of the motor and coring bit. Each of these movable guide plates is provided with a pair of slots, which for the most part are parallel and are in the form of a straight line with break slots at the ends thereof. Sidely mounted adjacent each said guide plate is a fixed guide plate. Remotely controlled means are provided to move the movable guide plates along the fixed guide plates.

The fixed guide plates are each provided with a pair of spaced apart slots which extend through the plate. It is the arrangement or configuration of these slots which provide the transverse and rotational movement of the core bit. The transverse section of the fixed plates can be described as two parallel spaced apart slots. The rotational portion is an extension of these two parallel slots and at an angle with each slot, but the rotational portion of these slots are not parallel, but are arranged such as to obtain the desired rotation.

Opposite sides of the motor which rotates the drill bit are provided with two pins which fit into the parallel slots on said movable and said fixed guide plates. Means are provided to move the movable guide plate between an upper and a lower position. Movement of the movable guide plate causes the pins of the motor to follow the rotating section of the fixed guide plates, thus causing the motor to rotate from its retracted position in the housing in which the longitudinal axis of the core barrel makes a small angle with the axis of the frame of the coring tool to a larger angular position aligning the barrel with the housing opening. The pins then engage the transverse section of the fixed plate and continued downward movement of the movable plates causes the coring bit to extend to the sidewall. At the same time that the coring bit is forced against the sidewall, the motor is being operated to rotate the bit to cut a core. By reversing the direction of the force on the movable guide plates, the core barrel can be retracted into the housing.

A better understanding of the invention may be had from the following description taken in conjunction with the drawing.

BRIEF DESCRIPTION OF THE DRAWINGS

FIG. 16A is a view of the fixed plate showing the horizontal section and arcuate section of the fixed slot.

FIG. 16B is a view taken along the line B—B of FIG. 16A.

FIG. 17A is a schematic view of the sliding plate showing the pair of slots therein.

FIG. 17B is a section taken along the line B—B of FIG. 17A.

FIG. 21A is an isometric view showing the guide pinions of the motor.

DETAILED DESCRIPTION OF THE INVENTION

Figure 1:
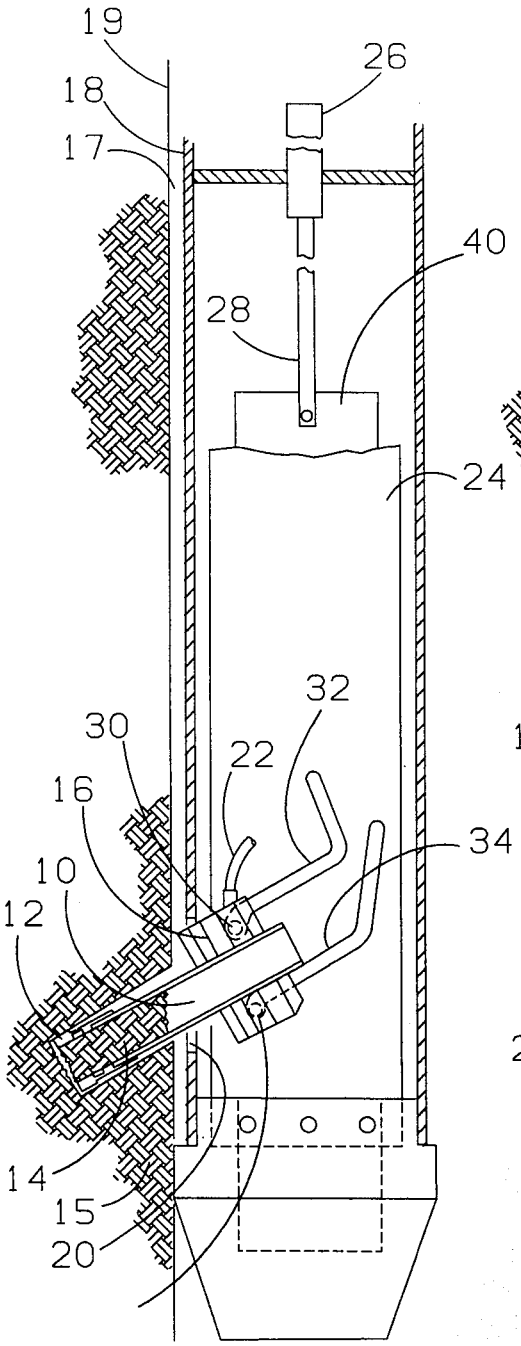
FIG. 1 is a schematic view depicting a core cutting means suspended in a borehole with core bit and core barrel fully extended with a cut core.

FIG. 1 illustrates a core retaining barrel 10 having core bit 12 in an extended position and also having a cut core 14. The core bit 12 is rotated by barrel 10 connected to a hydraulic motor 16. The motor is supported by an elongated frame member 18 which is preferably a steel cylinder having an opening 20 through which the core barrel 10 extends. Elongated member 18 is suspended by means not shown in a hole 17 having a sidewall 19. Power for rotating the hydraulic motor 16 is provided by flexible conduit 22 from a downhole pump not shown. Also shown in FIG. 1 is a movable plate 40 which is slidable with respect to housing 18. Plate 40 is slidably mounted by any well known means such as bearings from the housing 18. Drive motor 26 is secured to frame 18 and is connected to movable plate 40. A drive motor 26 has ram 28 which is used for moving the movable plate 40 in either an up or down direction. It is thus seen there is one power source for driving the plate 40 which in turn extends and retracts the core barrel 10 and associated bit 12. There is a second hydraulic system which is connected through conduit 22 to motor 16 to cause it to rotate. These two hydraulic sources can be the same as that shown in U.S. Pat. No. 4,280,569 issued July 28, 1981 for "Fluid Flow Restrictor Valve for a Drillhole Coring Tool," Houston B. Mount II, inventor.

Motor 16 has a pair of guide pins 30 and 33 which extends through the slots 32 and 34 of fixed plate 24. As will be explained in relation to the other figures of the drawing, it is the movement of plate 40 which, together with its slots and with the guide slots 32 and 34 of the fixed plates 24 which is the force and guiding means for moving the core barrel 10 into and away from the sidewall formation 15.

Figure 2:
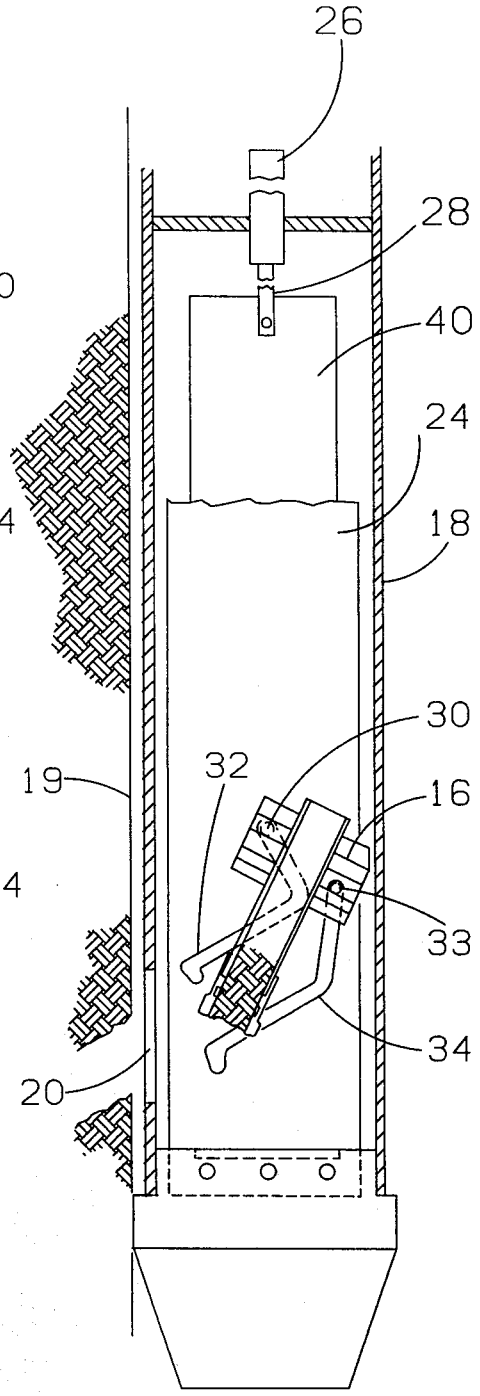
FIG. 2 is a schematic view depicting the core cutting means of FIG. 1 in a retracting position with a retained core.

FIG. 2 is similar to FIG. 1 except that the movable plate 40 has been raised to an upper position so that the core retaining barrel is completely within cylindrical housing 18.

Figure 3A:
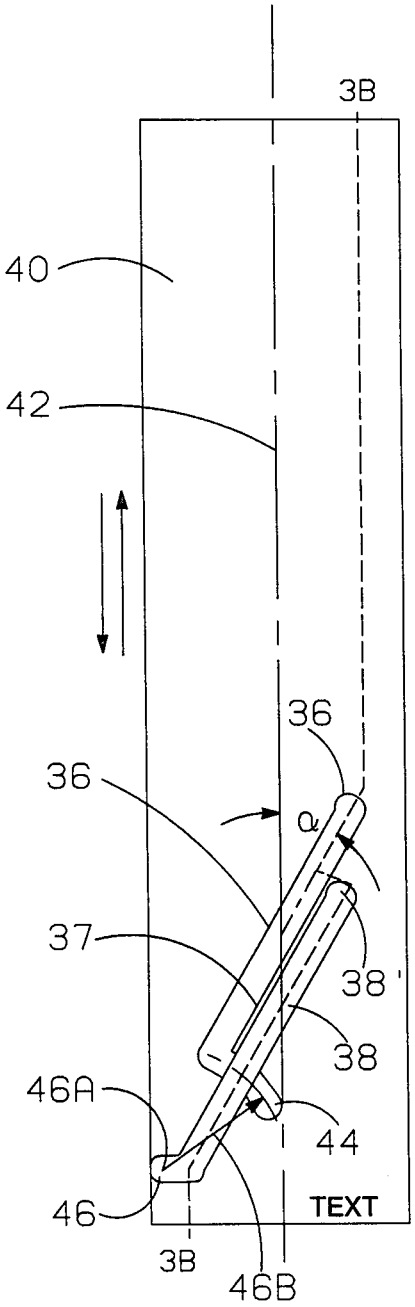
FIG. 3A is a view of the movable plate showing the pair of slots therein.

FIG. 3A illustrates a plan view of the movable plate 40. This plate is slidably mounted in housing 18 such as by bearings, etc., to have limited vertical movement between an upper and a lower position. Two slots, 36 and 38, are shown therein. Slots 36 and 38 are cut into guide plate 40 with slot 38 being deeper than slot 36. The major portion of the two slots are parallel and the upper end of each slot is provided with a break or deflection section 36' and 38'. The main section of slots 36 and 38 make an angle $\alpha$ with respect to the center line 42 of the guide plate 40. This center line 42 is parallel to the longitudinal axis of housing 18. The lower end of slot 36 is provided with a leg 44 and the lower portion of slot 38 is provided with a leg 46. These extremes of legs 44 and 46 are where the guide pins of 30 and 33 of the motor are when the device is fully retracted. This is in cooperation with the slots of the fixed plate 24 and pins 33 and 34. The slot 38 is deeper than slot 36 so that the long guide pin of the motor cannot enter the slot 36.

Slot 36 has a leg 44 whose center line is an arc of a circle having a center at point 46A which is at about the center of leg 44. The arc begins at the lower edge 37 of slot 36. The radius 46B of this arc is equal to the distance between pins 30 and 33. Leg 46 of slot 38 is at approximately a right angle to longitudinal line 42 of the movable plate 40 and extends approximately the length of the width of slot 38. This provides for the center of pin 33 to position itself at center 46A.

Figure 3B:
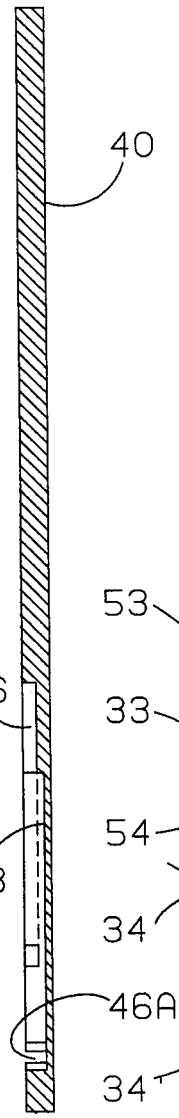
FIG. 3B is a section taken along the line 3B—3B of FIG. 3A.

FIG. 3B is a sectional view taken along the line 3B—3B of FIG. 3A.

Figure 4:
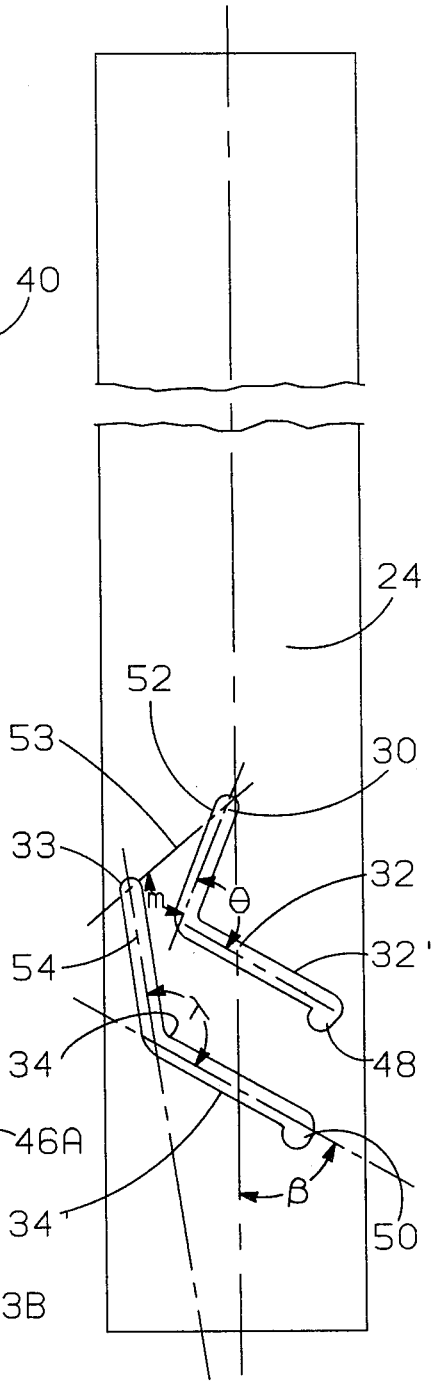
FIG. 4 is a schematic view of the fixed plate showing the pair of slots therein.

FIG. 4 illustrates slots 32 and 34 within fixed plate 24. Slots 32 and 34, respectively, have parallel sections 32' and 34'. Sections 32' and 34' each make an angle $\beta$ with respect to the longitudinal axis of the fixed plate 24 which is in a direction parallel to the longitudinal axis 42 of the movable plate 40 as shown in FIG. 3A. The lower end of slots 32 and 34 are each provided with break notches 48 and 50, respectively. These, in cooperation with the pins of the motor and the slots 44 and 46 of the movable guide plates 40, provide for breaking the core off when the core bit and barrel has reached its outermost extension. Slots 32 and 34, respectively, have upper legs 52 and 54 which each are straight section but are not parallel to each other. It is the relationship of legs 52 and 54 which provides for the rotational movement of the core retaining barrel 10 and motor 16 as plate 40 is moved.

The lower leg members 32' and 34' of the slots of the fixed plate 24 can be called the transverse guide portion of the system, and it is these slots which, in cooperation with slots 38 and 36 of movable plate 40, provide for the movement of the core barrel 10 toward and into the sidewall 15. The angle $\beta$, as shown in FIG. 4, determines the angle at which the core will be cut. I have found that an angle $\beta$ of about 60° gives a very satisfactory core and reduces the friction problems to an acceptable level. If friction is not too great, angle $\beta$ may be as great as 70°. Angle $\beta$ may be practically as little as 45° if friction is significant. The lower limit is set by practical consideration of the amount of core to be cut, the smaller the angle the less core can be cut for a given extension of the core barrel. However, as a practical matter, the tool can be used with $\beta$ of different angles which can vary over a range from about 45° to about 70°. It is preferred that angle $\beta$ and $\alpha$ are complementary to reduce friction. The slope (angle $\alpha$) of slots 36 and 38 determines the amount of transverse movement of the motor and core barrel for a given movement of movable plate 40. With regard to $\beta$, I have found that 60° is usually believed acceptable.

Upper legs 52 and 54 of the slots 32 and 34 of fixed plate 24 provide for the rotational movement of the coring barrel.

Legs 52 and 54 make different angles $\theta$ and $\lambda$, respectively, with sections 32' and 34'. In one prototype embodiment, angle $\theta$ is about 90° and angle $\lambda$ is about 135°. Legs 52 and 54 are about the same length. A line 53 is drawn between center positions of pins 30 and 33 when each is in the uppermost position of legs 52 and 54, respectively. Line 53 makes an angle m with the longitudinal axis of leg 52. Angle m determines the amount of rotation of motor 16 between the position indicated in FIG. 7 and when pins 30 and 33 first enter leg sections 32' and 34'. The angle indicated herein in regard to FIG. 3A and FIG. 4 are such as to keep friction within acceptable levels and are preferred.

Figures 5A, 5B, 5C:
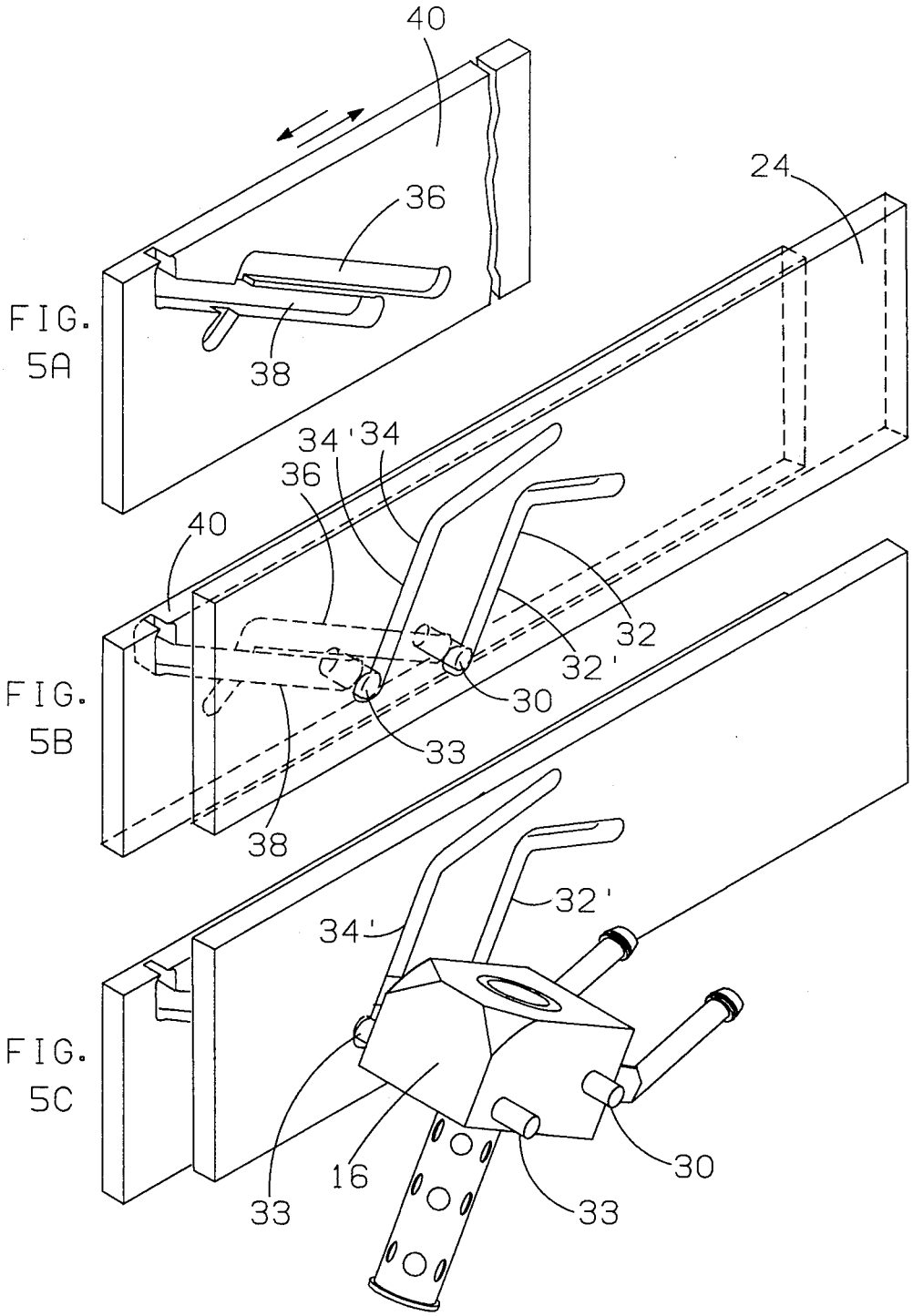
FIG. 5A is an isometric view of the movable plate showing the slot.
FIG. 5B is an isometric view showing the fixed plate in relation to the movable plate.
FIG. 5C is an isometric view showing the relationship of one fixed plate, one movable plate, and the drilling motor and guide pins.

Attention is next directed to FIGS. 5A, 5B, and 5C to indicate how the guidance system is arranged. FIG. 5A is an isometric view of the movable plate 40. FIG. 5B has the fixed plate 24 positioned in front of the movable plate 40. FIG. 5C has added thereto motor 16 with pins 30 and 33. Pin 33 is of greater length than pin 30, and because of this greater length will track only in deeper slot 38 of movable plate 40. As movable plate 40 moves, pin 33 tracks along in slot 34 of fixed plate 24 and slot 38 of movable plate 40. Short pin 30 tracks along slot 32 of fixed plate 24 and shallow slot 36 of movable plate 40.

As plate 40 is moved downwardly, the two pins, 30 and 33, will follow slots 34' and 32'.

Figure 6:
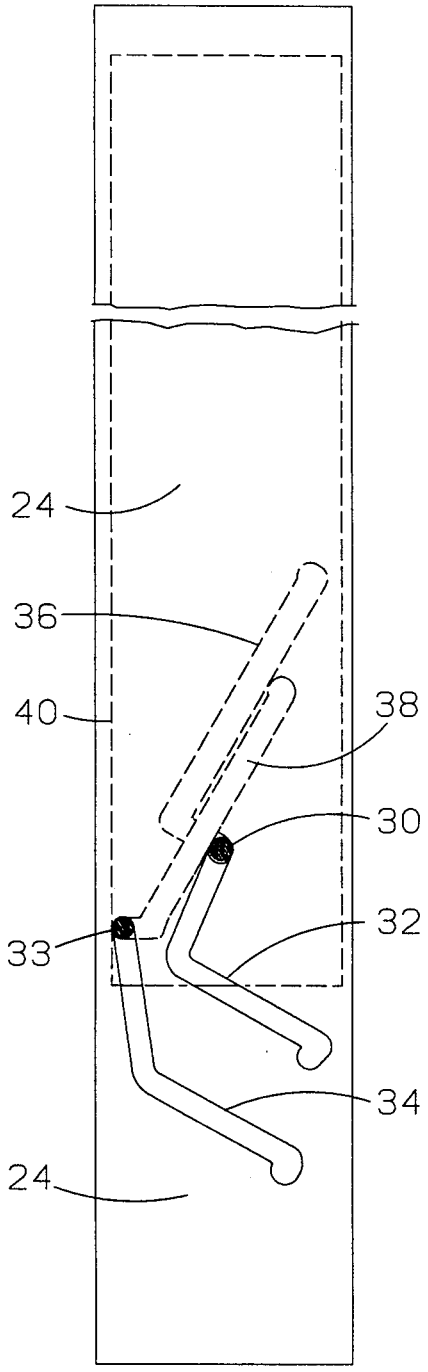
FIG. 6 is a plan view showing the relationship of the slots of the fixed and movable plates and the guide pins of the bit device motor and depicting a position in which the core barrel and motor are in the fully retracted position.
Figure 7:
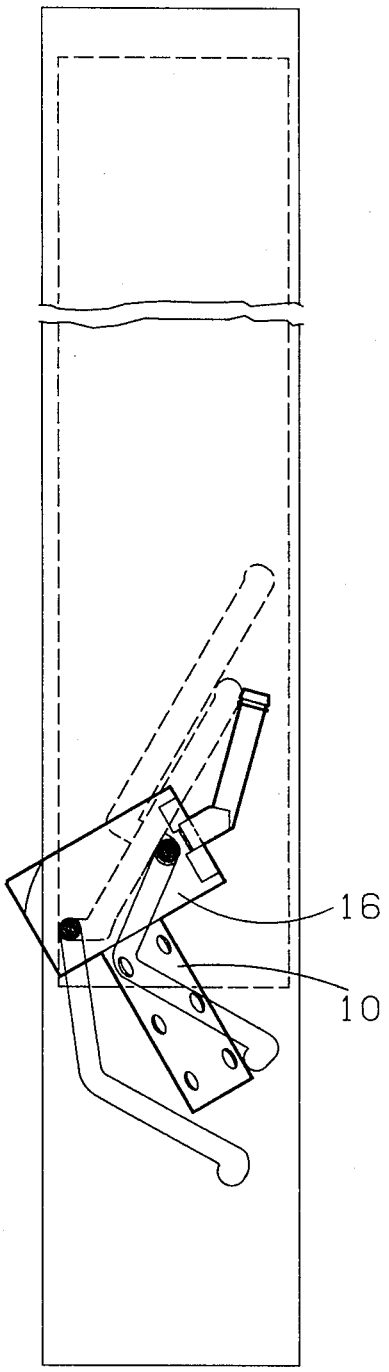
FIG. 7 is similar to FIG. 6 except that the outline of the bit drive motor and core barrel has been added.

Attention is next directed to FIGS. 6 and 7. Shown here, the drill 16 is in its most retracted position. This is indicated in FIG. 6 which clearly shows the position of pin 30 in shallow slot 36 of the movable plate and pin 33 in the deep slot 38. These pins extend respectively through slots 32 and 34 of fixed plate 24. Plate 24 also may act as a bushing for motor 16 depending on the length of pins 30 and 33 and the assembly position selected. The position of pins 30 and 33 determine the position of motor 16 and core barrel 10. The pins are in their uppermost position insofar as slots 32 and 34 are concerned and in the lower position concerning slots 36 and 38.

Figure 8:
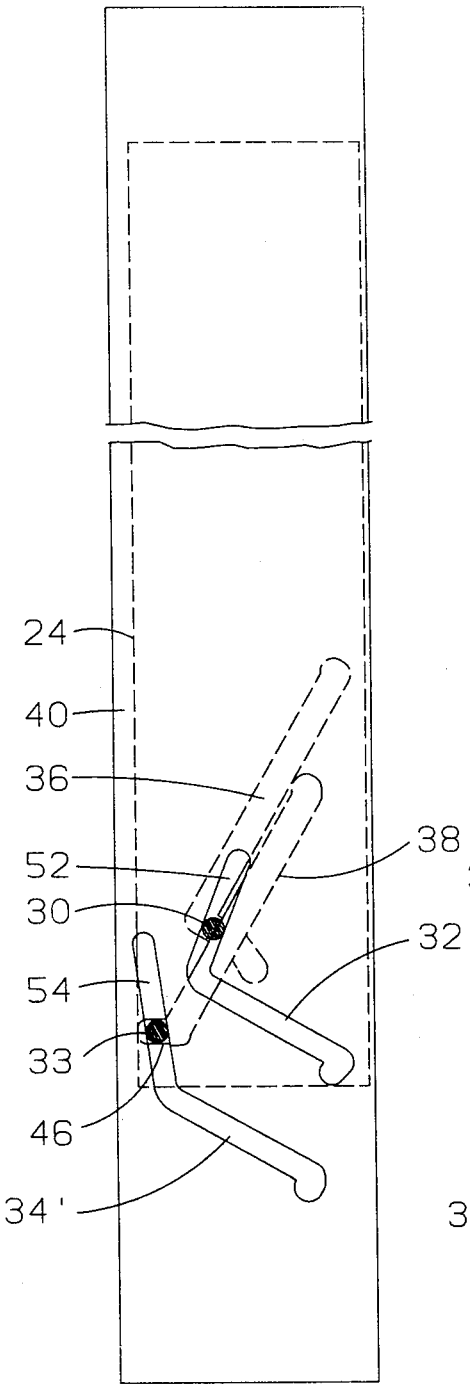
FIG. 8 is similar to FIG. 6 except that the movable plate has been moved to an intermediate position such that the core barrel and motor have been rotated slightly.
Figure 9:
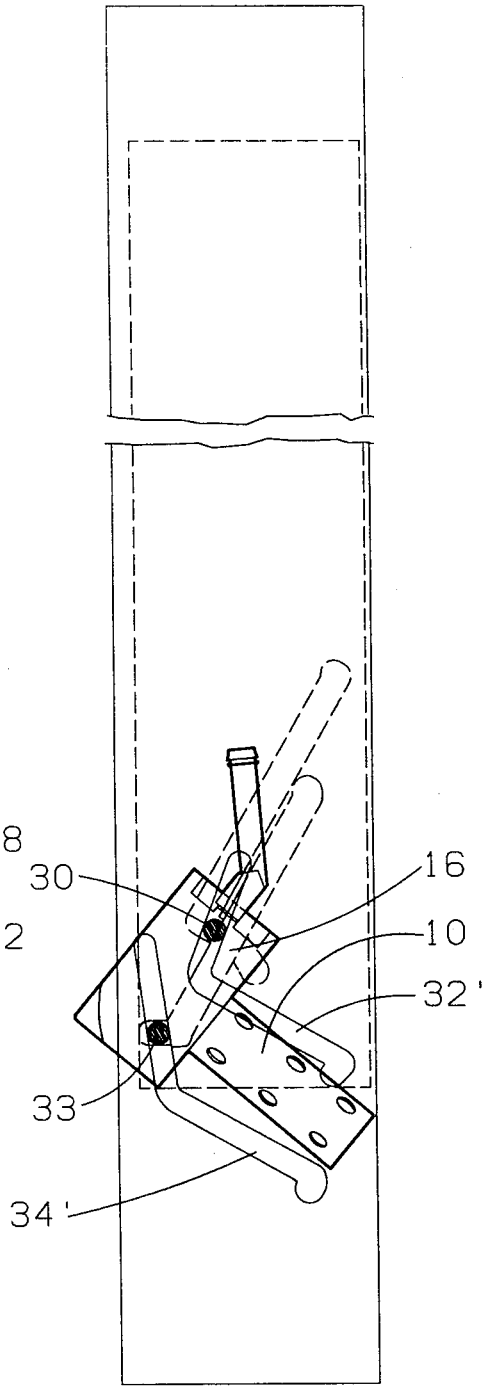
FIG. 9 is similar to FIG. 8 except that the outline of the bit drive motor and core retaining barrel have been added.

Attention is next directed to FIGS. 8 and 9. Here the downward movement of plate 40 has caused the pins to assume another position as shown in which the core barrel 10 and motor 16 have been rotated as indicated from the position shown in FIG. 7. Leg 54 holds pin 33 in leg 46 of deep slot 38 of the movable plate until pin 30 has crossed slot 38 and so that it will continue to follow the path defined by leg 52 of the slot in the fixed plate and the slot 36 in the movable plate.

Figure 10:
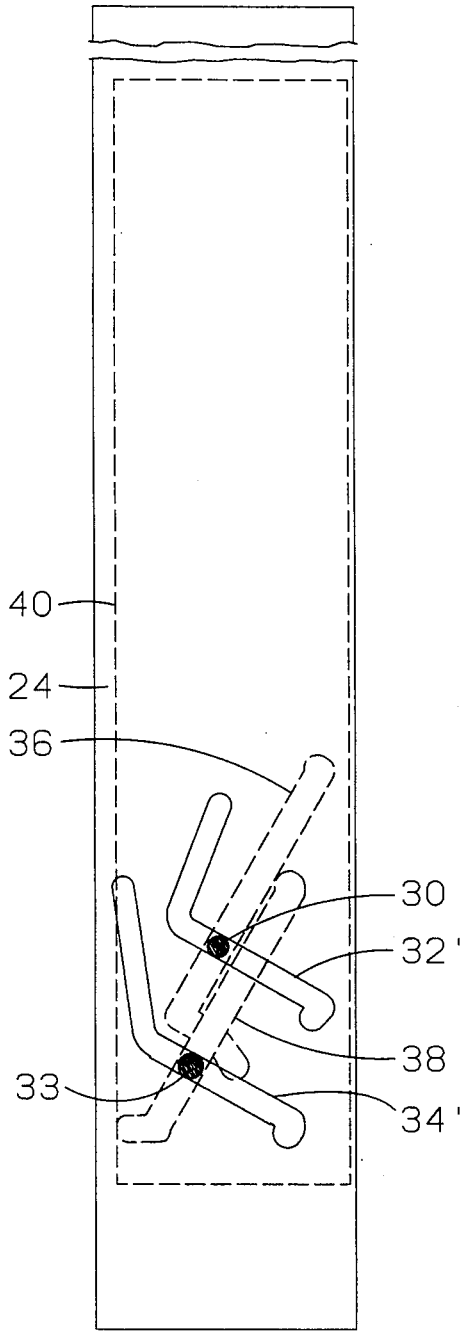
FIG. 10 shows a further relative position of the movable and fixed plates and the pins of the bit drive motor depicting a position in which the core barrel is partially extended.
Figure 11:
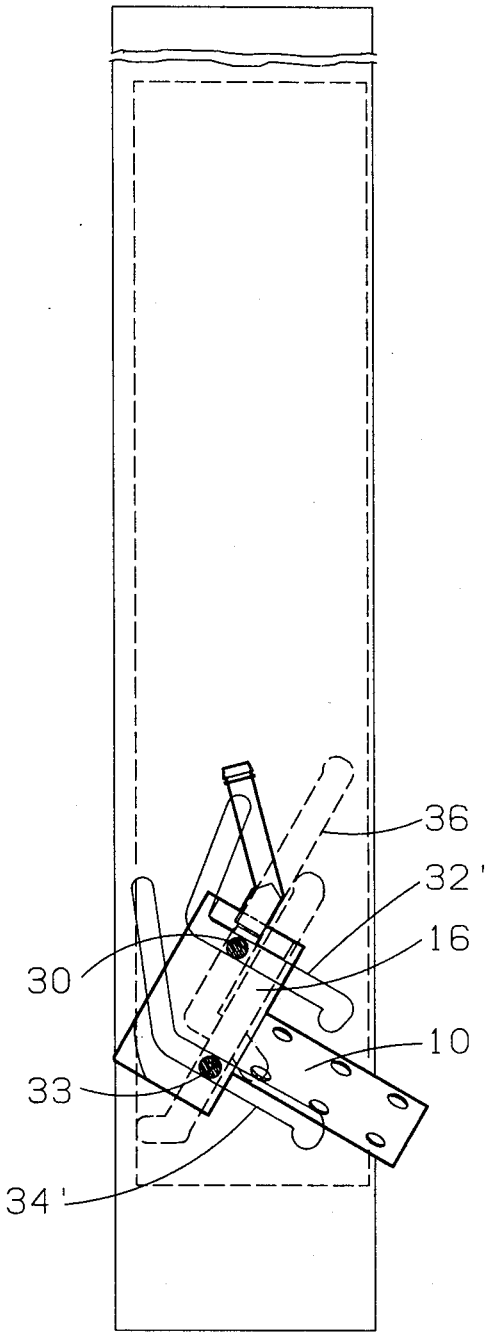
FIG. 11 is similar to FIG. 10 except that the core and its motor have been added thereon.

In FIGS. 10 and 11, the movable plate 40 has been lowered to still another position and at this point the pins 30 and 33 are in the transverse section of the slots in the fixed plate 24. Continued downward movement of the movable plate 40 causes pins 30 and 33 to follow the slots 36 and 38 which in turn forces the motor and core barrel to the right. Inasmuch as transverse sections 32' and 34' are sloped downwardly, the motor and core barrel must also move downwardly.

Figure 12:
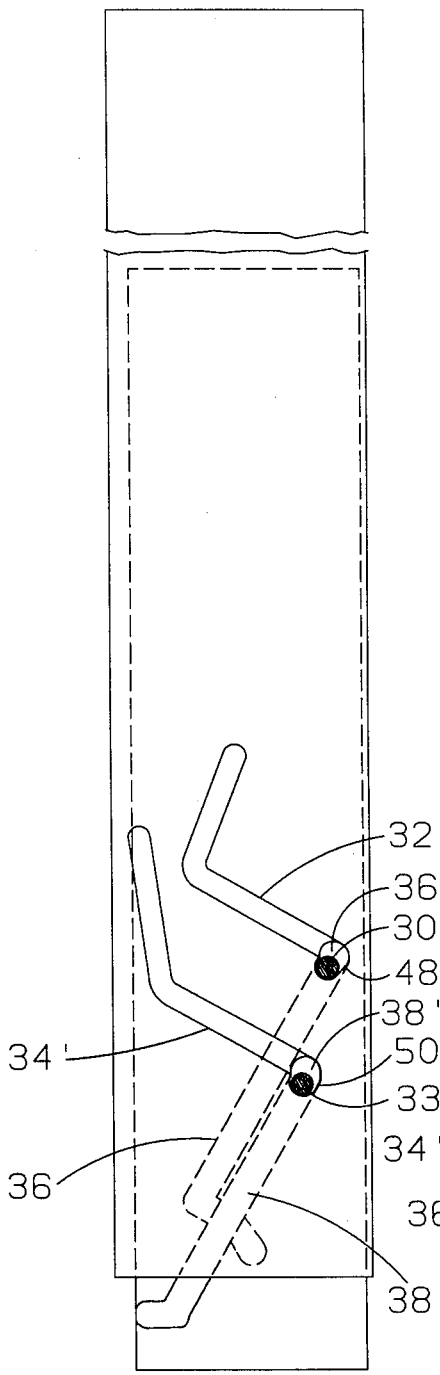
FIG. 12 is similar to FIG. 10 except that it depicts the position of the guide pins and movable plate when the core barrel is fully extended.
Figure 13:
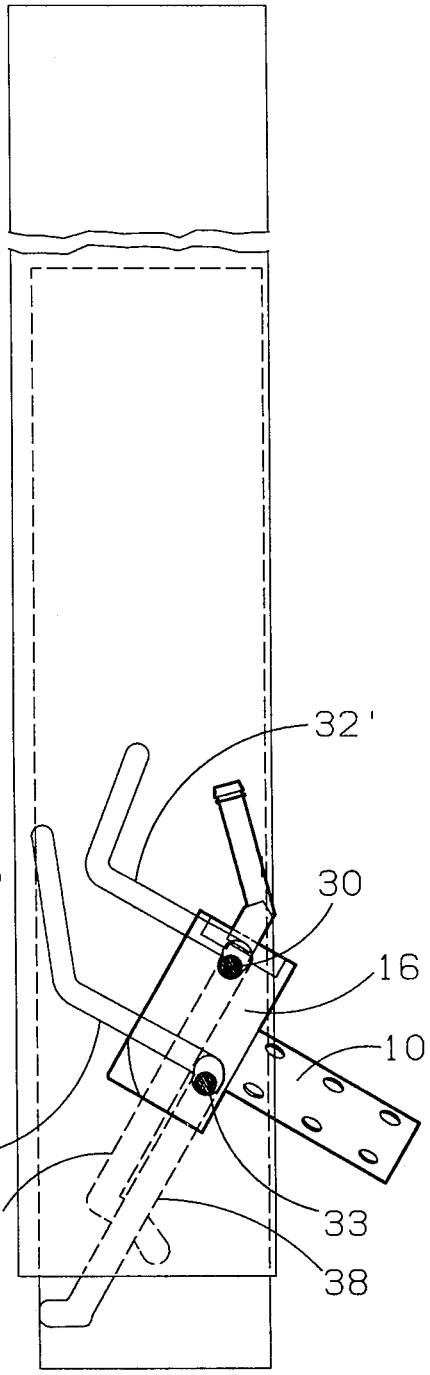
FIG. 13 is similar to FIG. 12 except that the core retaining barrel and the motor have been added thereon.

Additional downward movement of the movable plate 40 is continued until it reaches the position shown in FIGS. 12 and 13. There the pins 30 and 32 have reached the break portions 48 and 50 of fixed plate 24 and 36' and 38', 40 of the movable plate. When the movable plate has reached this point, it causes an abrupt change in direction of movement of the motor with respect to the longitudinal axis of the outer end of the core barrel 10, thus breaking the core from the sidewall. At this point the core is completely cut and has been broken from the sidewall. The tool is then retracted by moving movable plate 40 upwardly which reverses the sequence just described in regard to FIGS. 6 to 13.

The concept of the guide system using a fixed plate and a drive plate described above and claimed herein is applicable to embodiments other than that described in relation to FIGS. 1 through 13. For example, this concept is applicable to the embodiments described in the patent application Ser. No. 426,304 entitled, "Guide For Sidewall Coring Bit Assembly," filed of even date herewith. The embodiments shown herein in FIGS. 14 to 30 are described and claims in said patent application Ser. No. 426,304.

Figure 14:
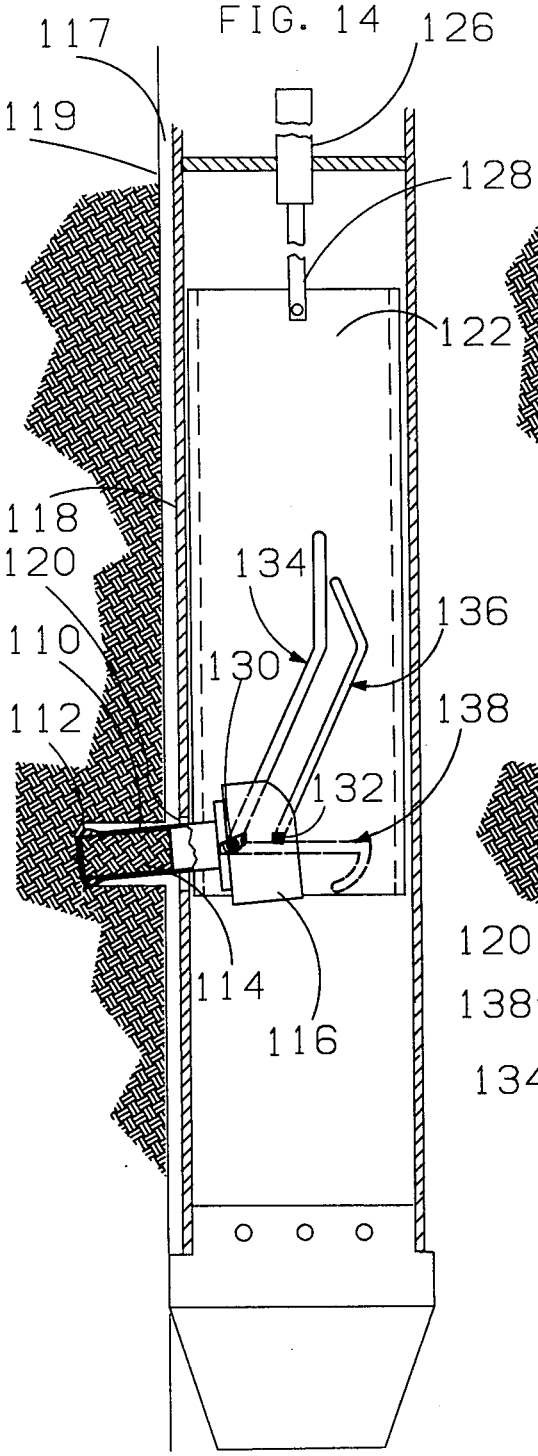
FIG. 14 is a schematic view depicting a core cutting means suspended in the borehole with a core bit and core barrel fully extended and containing a cut core and is similar to FIG. 1 except for different guidance tracks.

FIG. 14 illustrates a core retaining barrel 110 having a core bit 112 in an extended position and also containing a cut core 114. The core bit 112 is rotated by barrel 110 connected to a motor 116 which is preferably hydraulic. The motor is supported within an elongated frame member 118 which is preferably a steel cylinder having an opening 120 through which the core barrel 110 extends. Elongated member 118 is suspended by means not shown in a hole 117 having a sidewall 119. Also shown in FIG. 14 is drive plate 122 which is slidable with respect to housing 118. Plate 122 is slidably mounted by any well-known means such as bearings from the housing 118. Drive motor 126 having ram 128 is supported from housing 118. Ram 128 is connected to movable plate 122 and is used for moving the drive plate 122 in either an up or down direction. Motor 120 has forward pinion 130 and trailing pinion 132. Drive plate 122 has a forward slot 134 and a trailing slot 136. The fixed plate has a slot means 138. The configuration of these slot means are different from that of FIGS. 1 and 2. As will be explained, it is the cooperation of slots 134, 136 of drive plate 122 and slot 138 of the fixed plate and pinions 130 and 132 of motor 116 which controls the extension and retraction of core barrel 114. It is thus seen that there is preferably one power source for driving the plate 122 which in turn extends and retracts the core barrel 110 and associated bit 112. There is preferably a second hydraulic system which is connected through conduits not shown to motor 116 to cause it to rotate.

Figure 15:
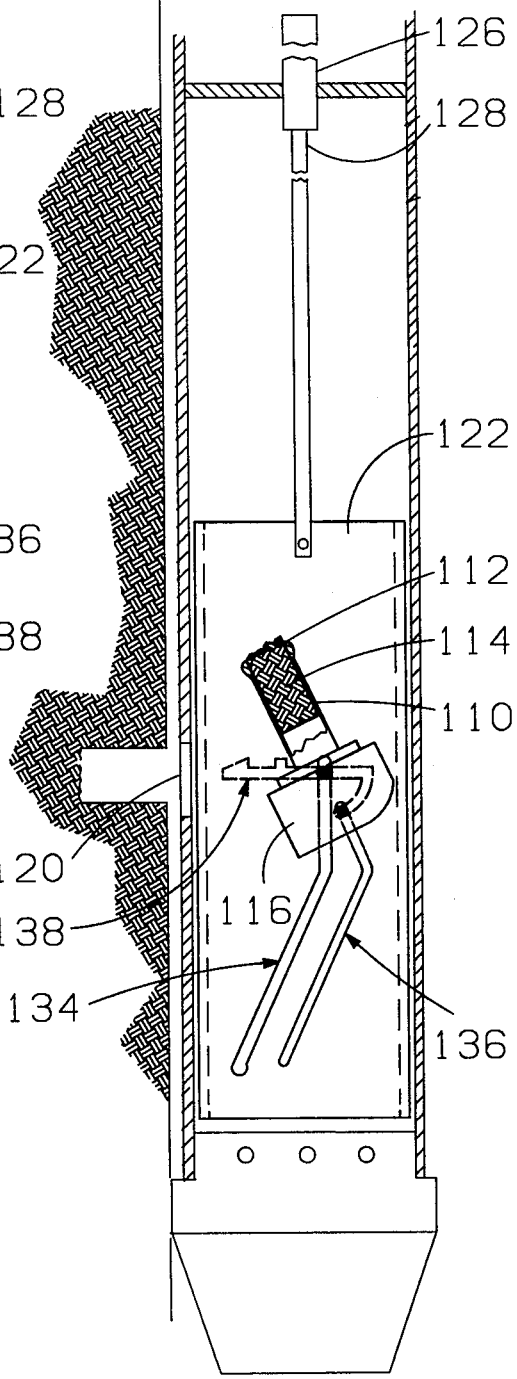
FIG. 15 is a schematic view depicting the core cutting means of FIG. 1 in a retracted position with a retained core.

FIG. 15 is similar to FIG. 14 except the core barrel with the core has been retracted and is in an upwardly tilted position. It is to be noted that the core barrel is either in a horizontal position as shown in FIG. 14 or in a tilted position such as shown in FIG. 15.

Figure 18:
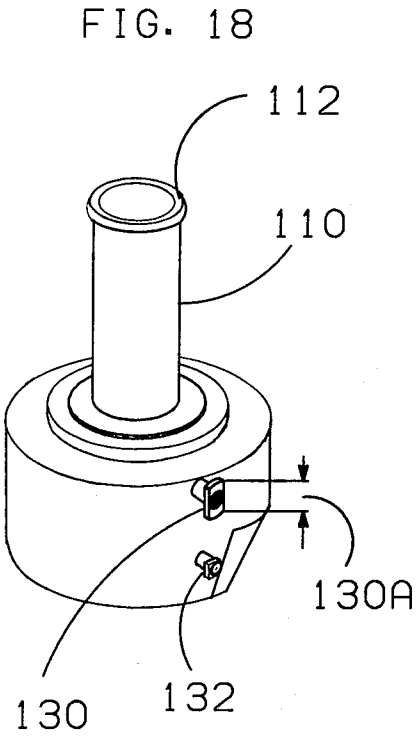
FIG. 18 is an isometric view of the motor, the core bit and core barrel.

FIGS. 16A and 16B illustrate the fixed plate and the fixed slot means and FIGS. 17A and 17B illustrate the sliding plate and the sliding slots therein. In FIG. 16A, there is shown fixed slot 138 having a horizontal straight section 138A. On the other end of the straight section opposite the opening 120 is an arcuate section 138B. Horizontal section 138A is perpendicular to the longitudinal axis of the housing 118. It also has a first break slot 142 and a second break or clearance slot 144. These two slots are the same distance apart as are pinions 130 and 132 of motor 116. Forward pinion 130, which is illustrated in FIG. 18, has a longitudinal dimension 130A which is greater than the width of slot 142. The trailing pinion 132 is of a dimension so it can enter slot 142. As shown in FIG. 16A, slot 144 has a slightly sloping surface 144A and average depth 144B which is slightly shallower than the depth of slot 142. The arcuate section 138B has a radius equal to the distance between forward pinion 130 and trailing pinion 132. The horizontal section 138A together with the slots of the sliding plate 122 provides for the extension and retraction in a horizontal direction of the drilling assembly including the motor 116, core barrel 110 and bit 112. The arcuate section 138B in cooperation with the slots of the sliding plate provides for the tilting or rotation of the drilling assembly between the horizontal position and the tilted position.

Attention is next directed to FIGS. 17A and 17B which shows the sliding or drive plate 122. It has a forward slot 134 and a trailing slot 136. Forward slot 134 has a lower section 134A which has a break slot 134C at the lower end. Forward slot 134 has an upper straight section 134B which makes an angle $\phi$ with the lower slot 134A. Trailing slot 136 has a lower section 136A which is parallel to the lower section 134A of the leading slot or forward slot and an upper section 136B which makes an angle $\mu$ with the lower section 136A. Angle $\mu$ is greater than the angle $\phi$. Angle $\phi$ and angle $\mu$ are such as to obtain the proper tilting of the drilling assembly in cooperation with the fixed slot 138. In this embodiment, upper section 134B is parallel to the longitudinal axis 139 of the sliding plate 122. Thus, when in an upright position upper section 134B is vertical. In one embodiment, angle $\phi$ between the lower section 134A and upper section 134B is approximately 155° and angle $\mu$ between the lower section 136A and upper section 136B is approximately 130°. Also in this embodiment the angle $\tau$ between section 134A and longitudinal axis 139 is approximately 30° and the angle of upper section 136B of trailing slot 136 makes an angle $\omega$ with the line 139. Typically, angle $\phi$ can be between about 140° and 170°, angle $\beta$ between about 120° and 140°, angle $\omega$ between about 20° and 40° and angle m between about 20° and 40°. Typically, slot 134 extends through the sliding plate 122 and is typically about 0.252 inches in width. The lower break slot 134C has a configuration which can accommodate movement of and receive forward pinion 130. Fixed slot 138 may, but need not, extend through fixed plate 137. The width of fixed slot 138 is typically about 0.252 inches. Typically, the width of pinions 130 and 132 which slide through these various slots is about 0.25 inches which gives a clearance of about 0.002 inches. The slot must be at such an angle to provide the most force on the pinion for a given direction and with the least amount of friction.

Figure 19:
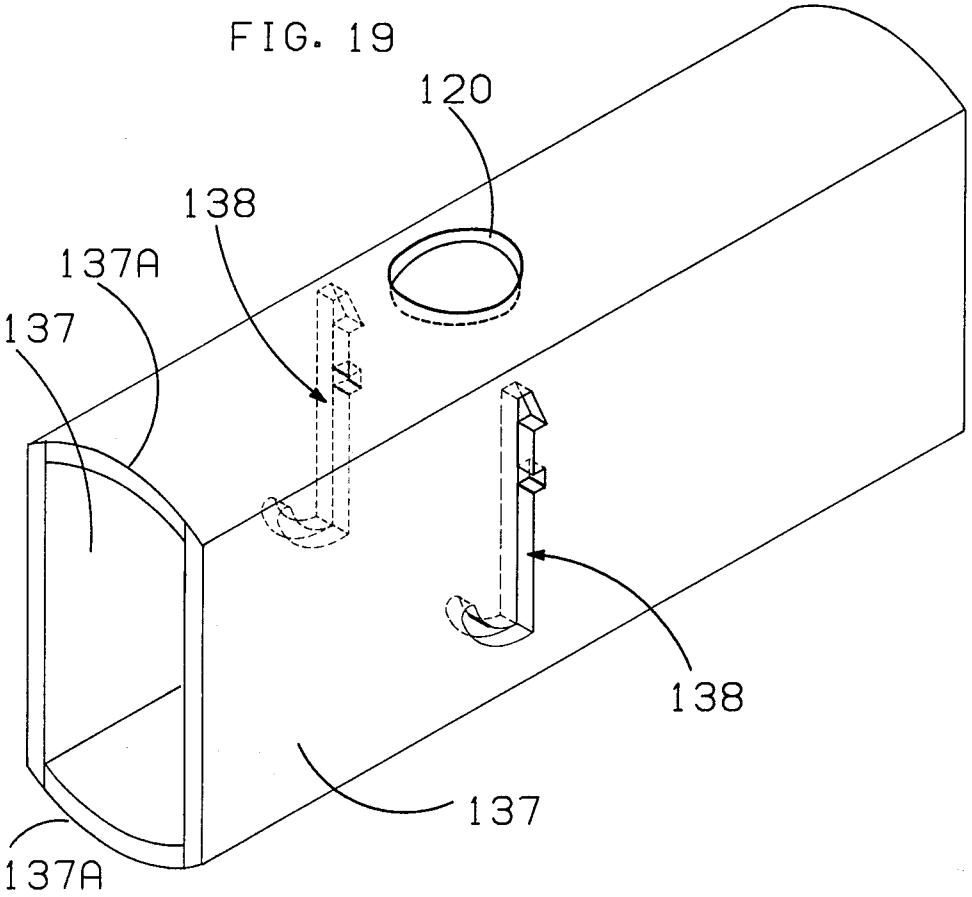
FIG. 19 is an isometric view showing the guide slot means in the fixed plates.

Attention is now directed to FIG. 19 which illustrates the fixed plate means shown in FIG. 16B in isometric form. Fixed plate 137 also has side members 137A which can be a part of the housing. The exterior of the housing 118 is preferably as illustrated in FIG. 14. However, this is not necessarily the case.

Figures 20, 21:
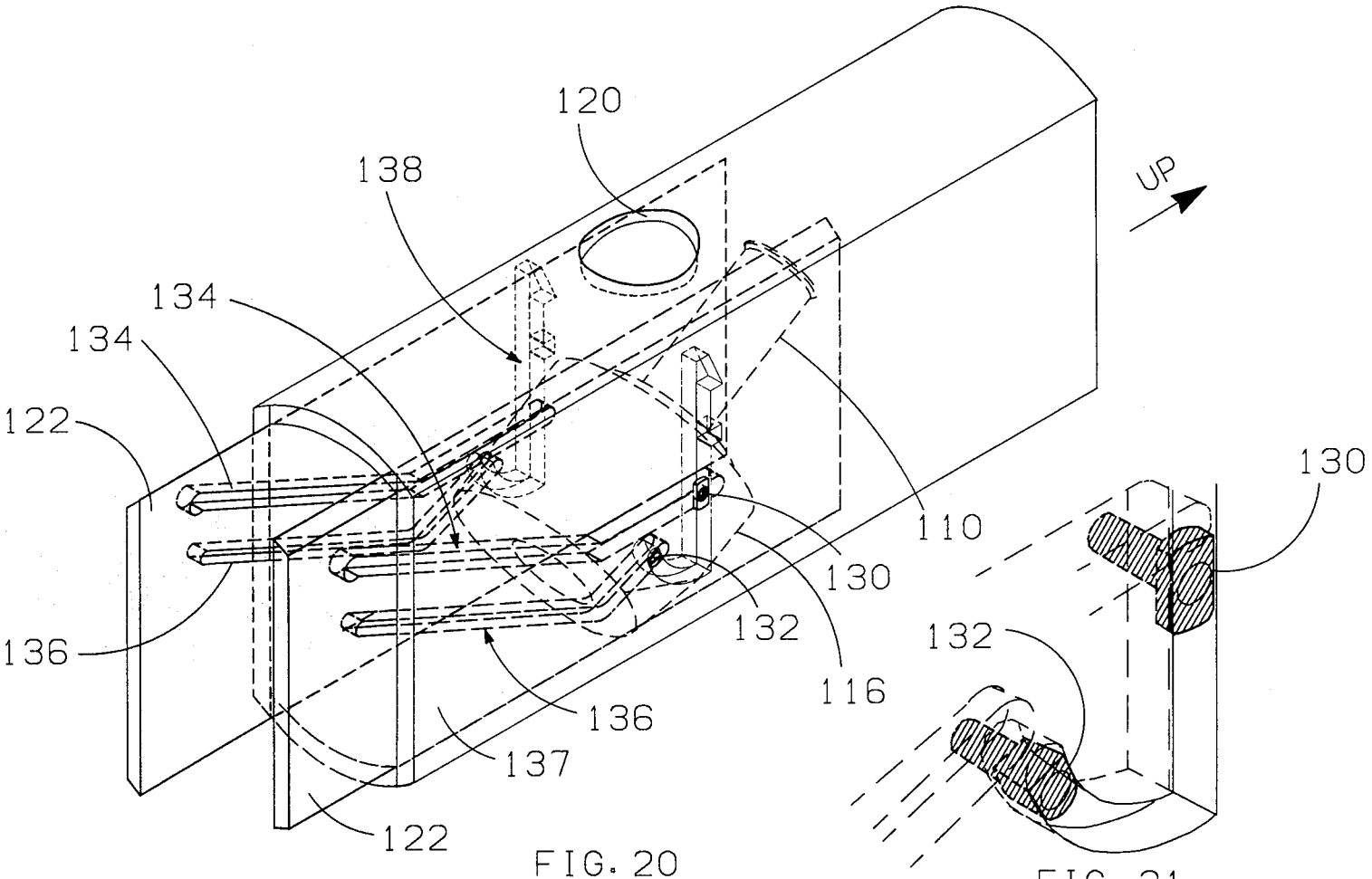
FIG. 20 is an isometric view showing the fixed plate in relation to the drive plates and motor and cutting assembly.
Figure 22:
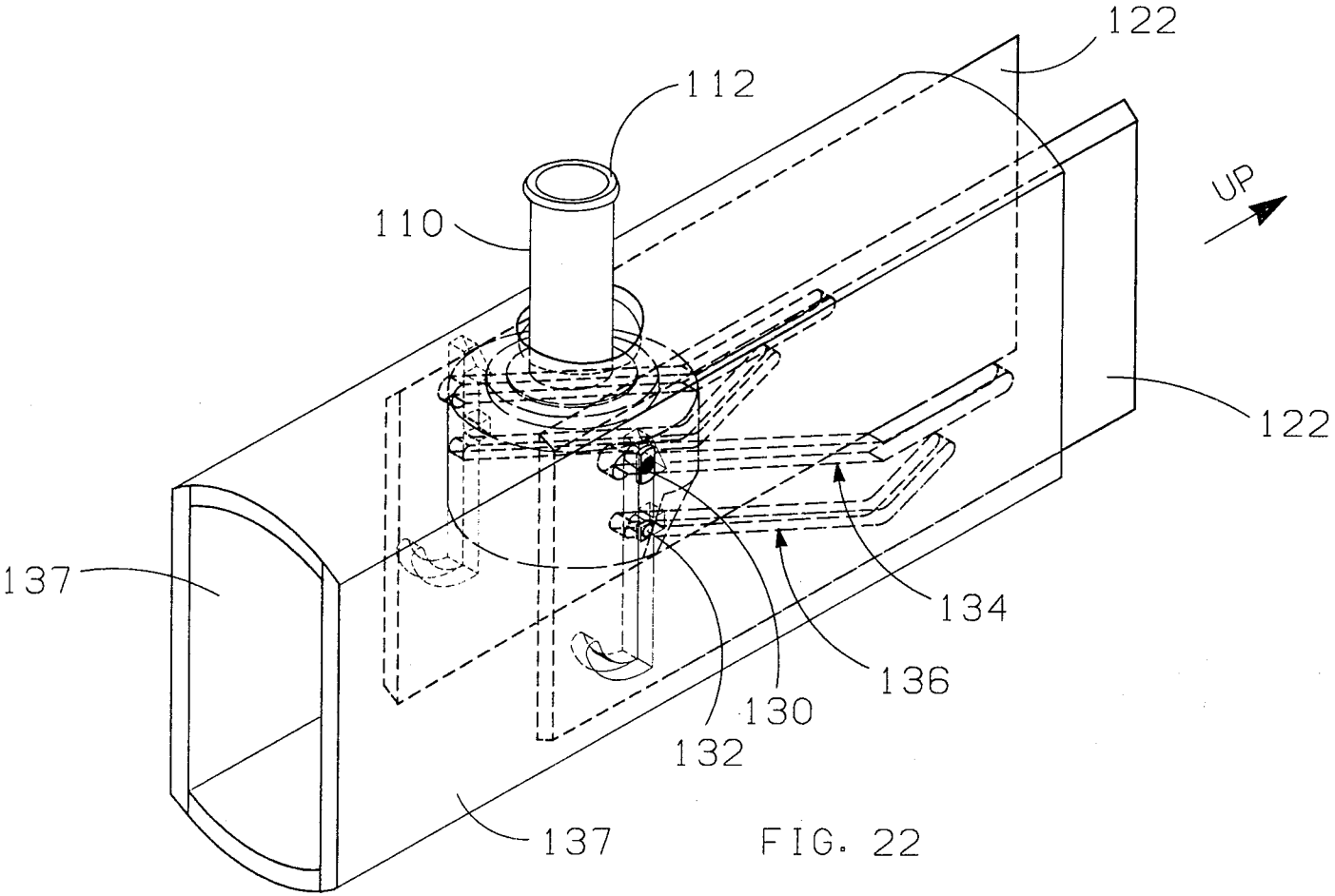
FIG. 22 is similar to FIG. 20 except that the motor and cutting assembly have been rotated and extended.
Figure 23:
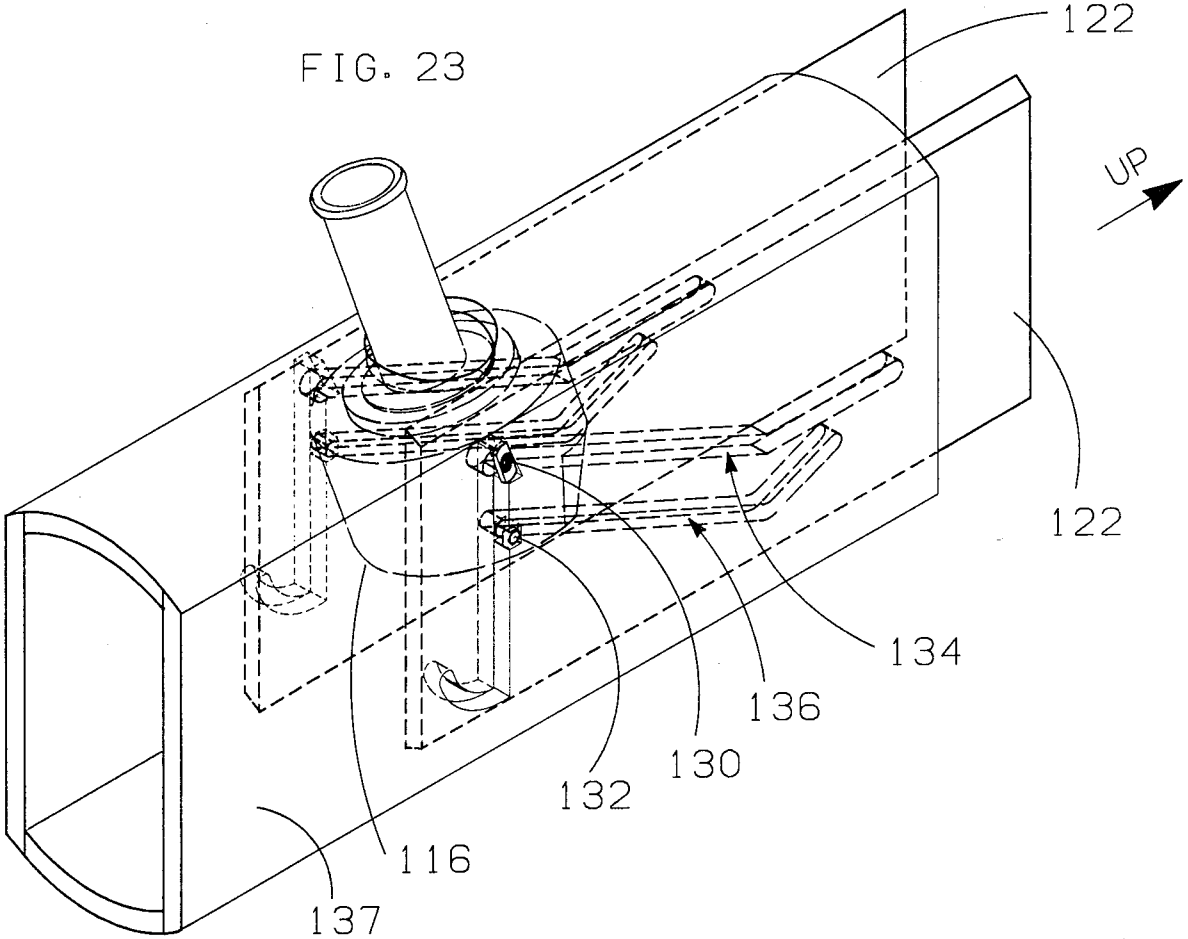
FIG. 23 is similar to FIG. 22 except that the core cutting mechanism has been tilted by the break mechanism.

Attention is next directed to FIG. 20 which is similar to FIG. 19 with the exception that the two sliding plates 122 and motor 116 with pinions 130 and 132 have been indicated therein. As can be seen, when in this position, core barrel 110 is tilted in an upwardly position. FIG. 21A shows the shape in enlarged view of the pinion 130 and 132 of FIG. 20. FIG. 22 is similar to FIG. 20 except that the plates 122 have been moved upwardly with respect to fixed plate 137 such that core barrel 110 and bit 112 are in a horizontal position. FIG. 23 is similar to FIG. 22 except it shows that the pinions 130 and 132 are in the break slot positions and core barrel 110 has been tilted slightly.

Figure 24:
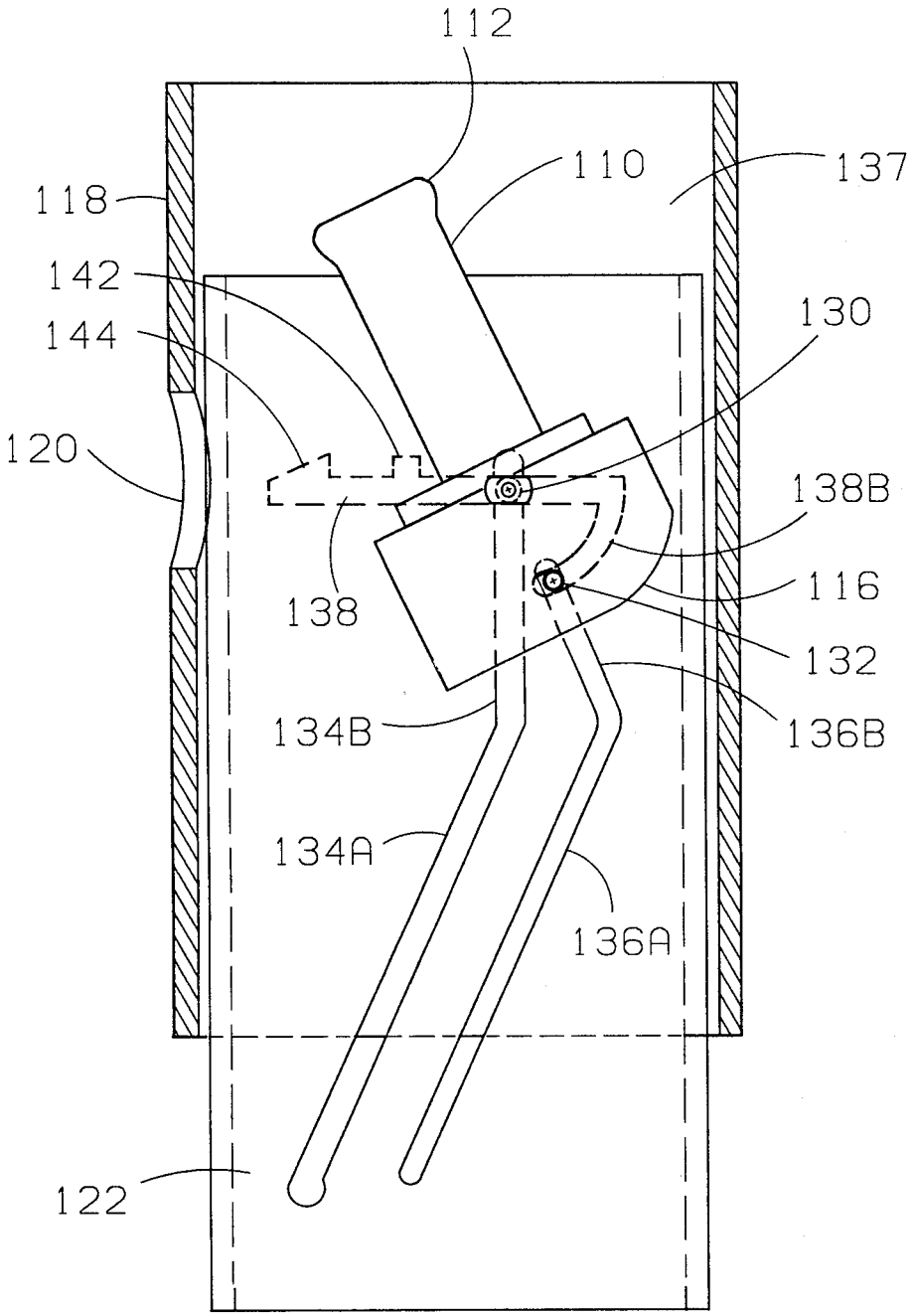
FIG. 24 is a plan view showing the relationship of the slots of the fixed plate and the drive plate when the core barrel is in a completely retracted and most upwardly tilted position.
Figure 25:
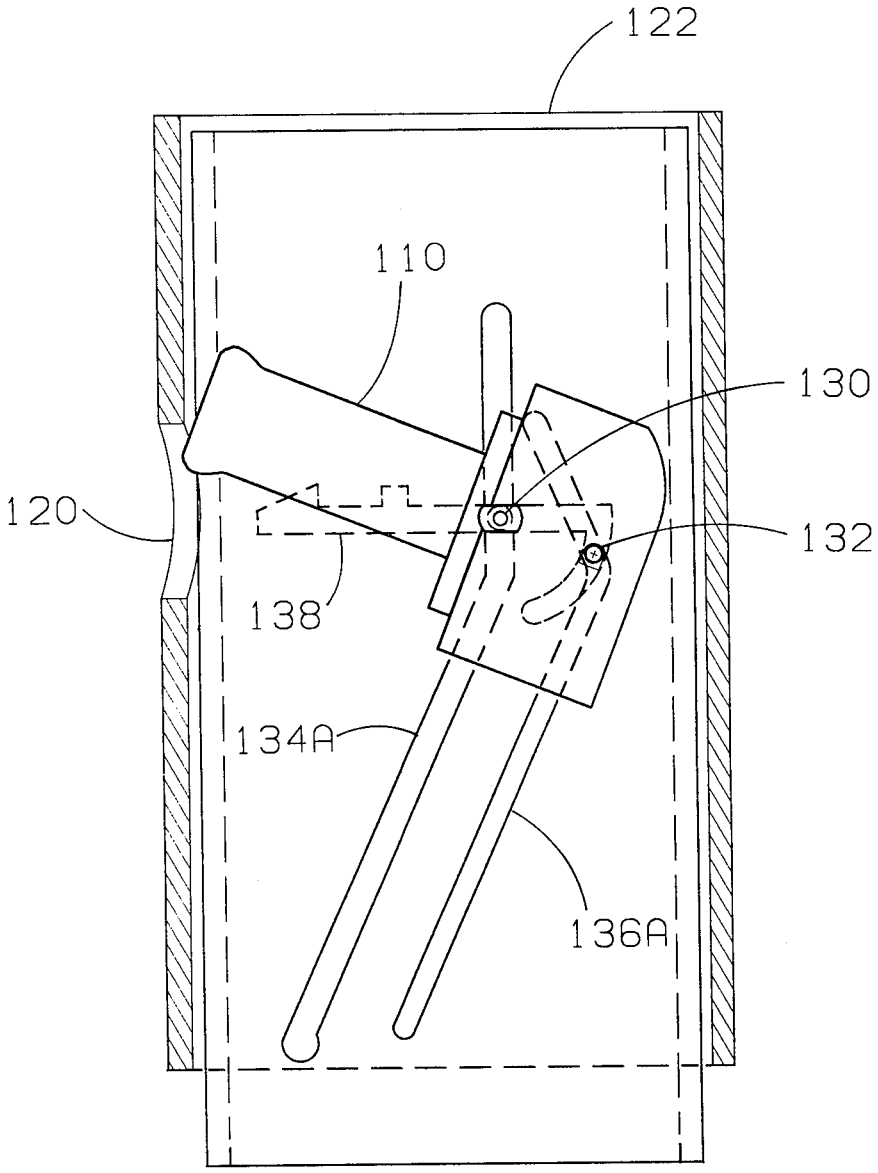
FIG. 25 is similar to FIG. 24 except the drive plate has been moved upwardly and the core barrel has been tilted downwardly.
Figure 26:
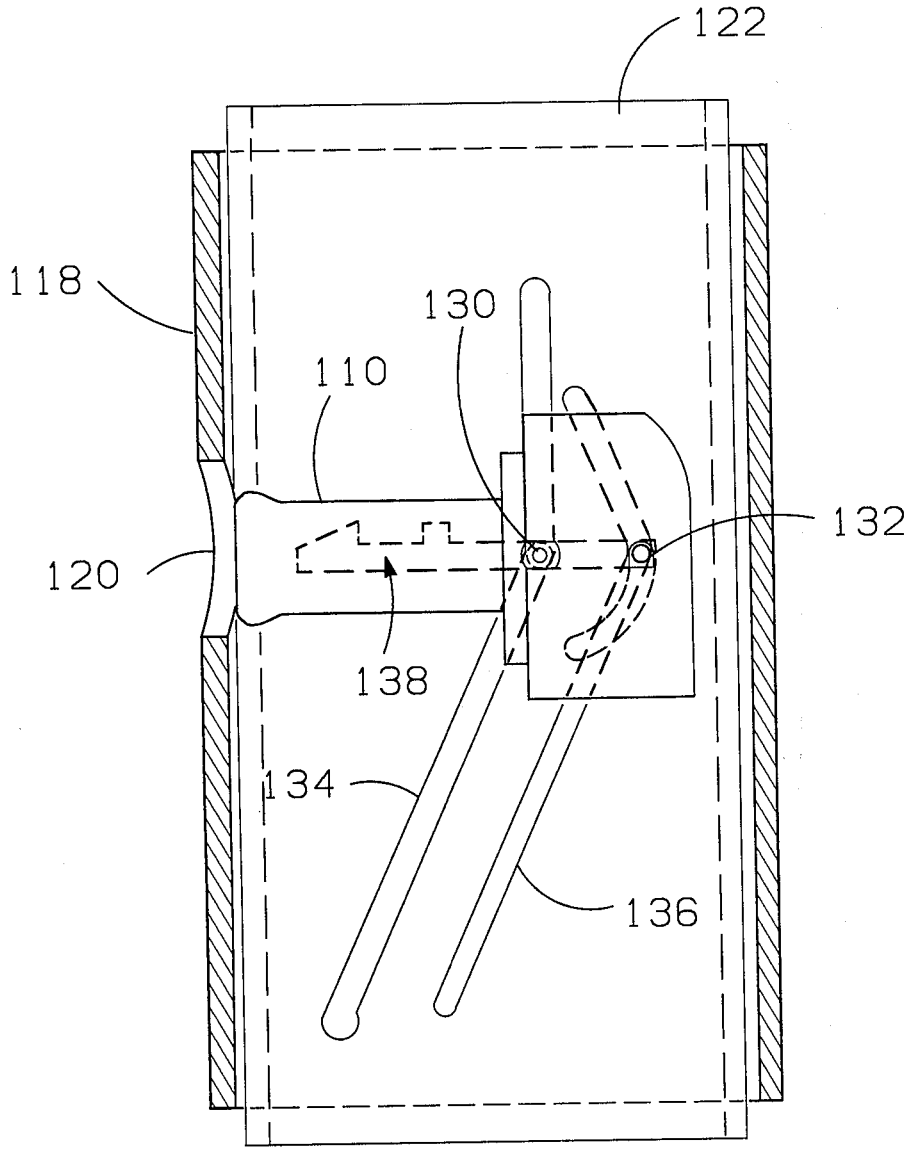
FIG. 26 is similar to FIG. 24 except in this figure the core barrel is in a horizontal position.

FIGS. 24–30 show the relationship of various relative positions between fixed plate 137 and the movable plate 122. The various parts shown in these Figures are identical except for the relationship caused by the change in the position of the movable plate or drive plate 122. In FIG. 24, core barrel 110 is tilted upwardly the maximum position for the particular configuration of guide slots. As can be seen the trailing pinion 132 is in the lower extremity of arcuate section 138B of the fixed slot. In FIG. 25, forward pinion 130 is still in the same position and only training pinion 138 has moved around the arcuate section 138B and core barrel 110 has been rotated downwardly from the position of FIG. 24. This is accomplished by movement of drive plate 122 upwardly from that shown in FIG. 24. In FIG. 26 drive plate 122 has continued to move upwardly and is now in a position where trailing pinion 132 is in line with the horizontal section of fixed slot 138. When in this position, the core barrel 110 is horizontal or perpendicular to the longitudinal axis of the fixed plate 137.

Figure 27:
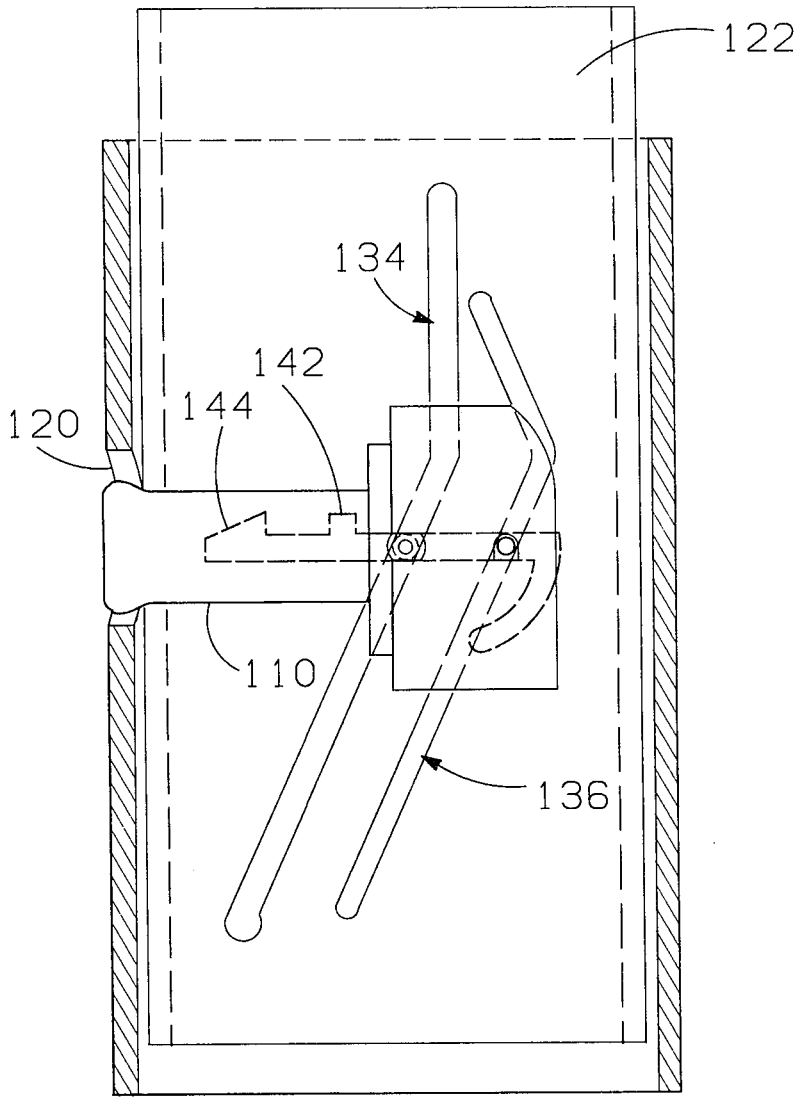
FIG. 27 is similar to FIG. 26 except the drive plate has been moved up slightly and the core barrel is slightly more extended than in FIG. 26.
Figure 28:
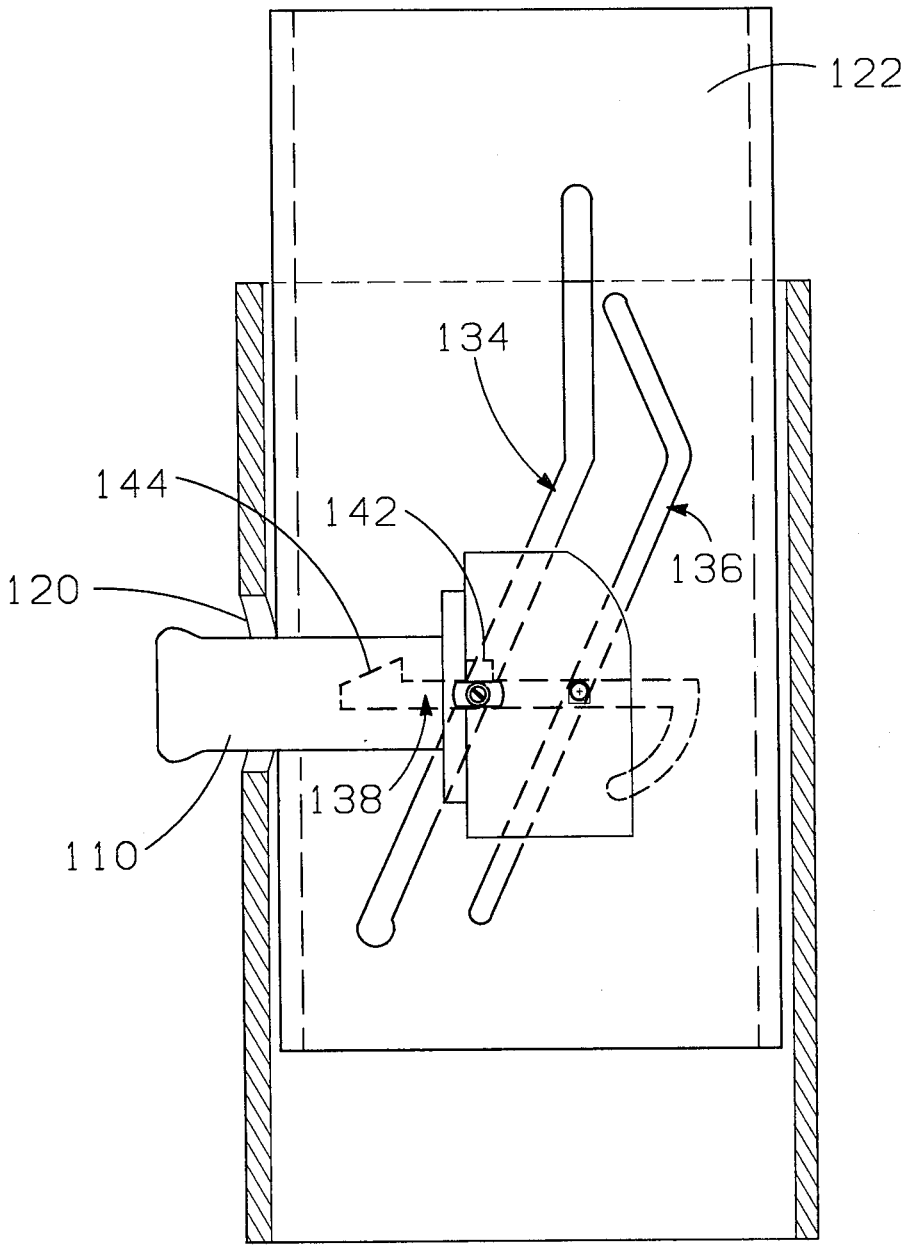
FIG. 28 is similar to FIG. 27 and shows the core barrel extended further.

Additional upward movement of drive plate 122 causes the core barrel 110 to extend through opening 120 and two steps in this sequence are shown in FIGS. 27 and 28. At about the stage shown in FIG. 27, motor 116 is actuated and remains operational until the core barrel is now in the position indicated in FIG. 29.

Figure 29:
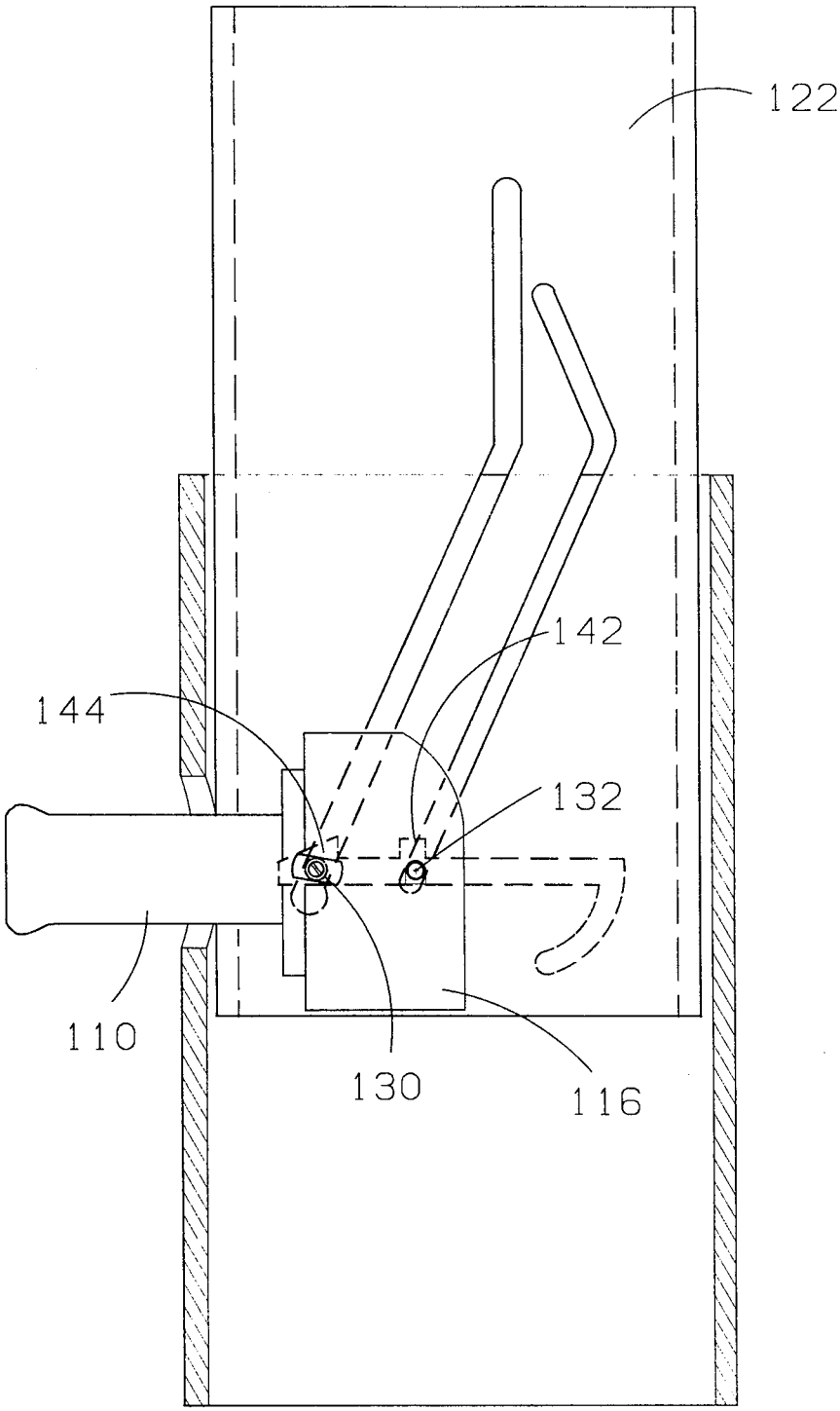
FIG. 29 is similar to FIG. 28 except the core barrel is extended to approximately the full limit.
Figure 30:
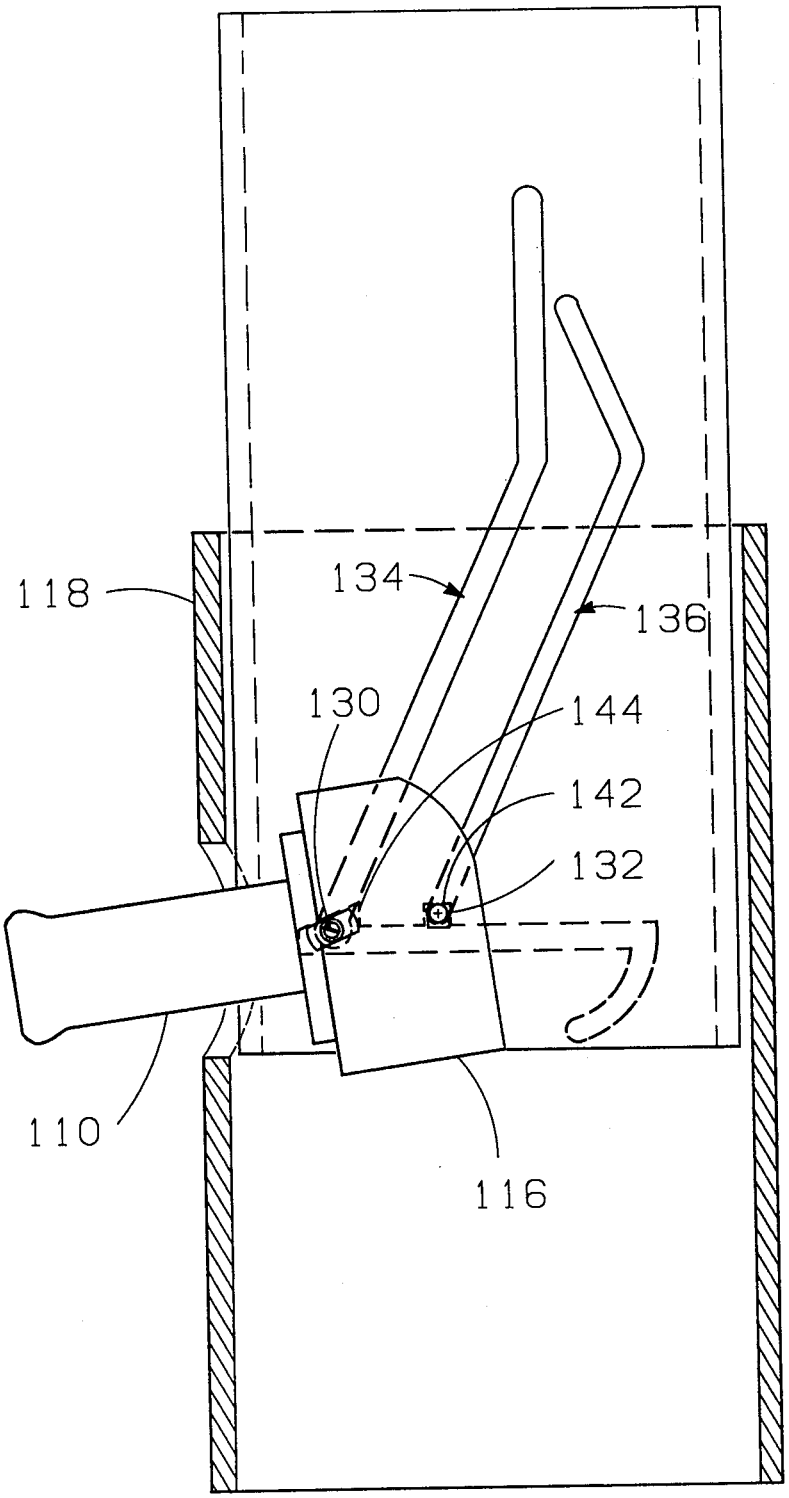
FIG. 30 is similar to FIG. 29 except that the pins of the motor have entered the break slots and the motor assembly has rotated upwardly by pivoting around the lower lip of the core head thus breaking the core loose from the rock.

Additional upward movement of plate 122 as indicated by its position shown in FIG. 29 causes the core barrel 110 to extend even further out to a nearly fully-extended position. FIG. 30 shows the pinions 130 and 132 in the break slots 144 and 142, respectively, of fixed slot 138. This shows that the hydraulic motor assembly has moved upward pivoting around the outer end of the core barrel 110 causing the core to break from the sidewall rock.

After the core has been cut and broken as indicated in FIG. 30, the core barrel can be retracted and returned to the position shown in FIG. 24 by merely moving the drive plate downwardly, and the sequence will be in the reverse order and will now be in the order of FIG. 30 back through FIG. 24.

While the invention has been described with a certain degree of paticularity, it is manifest that many changes may be made in the details of construction and the arrangement of components without departing from the spirit and scope of this disclosure. For example, movable plate 40 could be fixed, and fixed plate 24 could become the movable plate. It is understood that the invention is not limited to the exemplified embodiments set forth herein, but is to be limited only by the scope of the attached claims, including the full range of equivalency, to which each element thereof is entitled.

What is claimed is:

1. An apparatus for drilling a sidewall core from a borehole comprising:
   an elongated housing having an opening in the wall thereof;
   a fixed plate secured to said housing and having guide slot means;
   a drive plate adjacent to said fixed plate and movable in a straight line substantially parallel to the axis of said housing;
   drive means to move said drive plate; and
   a cutting assembly mounted in said housing and having guide means engaging said guide slot means and said drive plate to extend and retract said assembly through said opening of said housing in response to the movement of said drive plate.

2. An apparatus as defined in claim 1 in which said guide slot means includes:
   a first and a second spaced apart slots, each slot having a first long section parallel to a long section of the other slot which makes a selected angle $\beta$ with respect to the direction of the longitudinal axis of said housing;
   a break slot at the lower ends of each said long section;
   each said spaced apart slot having upper legs which are non-parallel and are at an angle to form a rotating guide for said core cutting assembly.

3. An apparatus as defined in claim 2 in which the angle $\beta$ is between about 70° and 45° and in which the upper leg of the upper of said spaced apart slots makes a right angle with the long section thereof.

4. An apparatus as defined in claim 2 in which the angle $\beta$ is about 60°.

5. An apparatus as defined in claim 2 in which the guide means of said core cutting assembly includes two pins which extend through the guide slot means of said fixed plate into drive slots of said drive plate.

6. An apparatus as defined in claim 5 in which there are two drive slots in said drive plate, each having a long section parallel to each other and the longitudinal axis of each forming a right angle with the direction parallel to the longitudinal axis of each said long section of each said slots of said guide slot means of said fixed plate;
   each said drive slot having a break notch at the upper end thereof, one of said drive slots being shallower than the other, each drive slot having a leg at the opposite end from said break notch, the leg of the deeper slot making a right angle to the longitudinal axis of such deeper drive slot and having a length of about that of the width of said drive slot;
   the shallower of said drive slots having an arcuate section at the end opposite its break notch and extending across the long section of said deep drive slot of said drive plate and having a radius equal to the distance between said two pins of said core cutting assembly and a center in said leg of said deeper slot.

7. An apparatus for controlling the movement of a drilling means for drilling into a sidewall of a borehole penetrating a subterranean formation within a housing means for placing the drilling means in drilling engagement with the sidewall of a borehole through a drilling engagement opening in the housing, wherein the drilling means comprises a motor with a rotor and planar faces on opposite sides of the motor which are parallel to the axis of rotation of a rotor and wherein the motor means moves within the housing toward and away from the drilling engagement opening which comprises:
   bushing means fixed within the housing and contiguous with the planar faces on opposite sides of the motor for controlling the lateral movement of the motor;
   guide track openings through the bushing means for defining movement of the motor means toward and away from the drilling engagement opening;
   engaging means connected to the planar facies on opposite sides of the motor for extending through the guide track opening,
   a drive plate contiguous with the bushing means but on the outside thereof with respect to said motor and movable between an upper and a lower position and engaging said guide track engaging means which extend through the guide track opening for moving the motor means outwardly and inwardly through the drilling engagement opening in response to movement of said drive plate.

8. An apparatus for drilling a sidewall core from a borehole comprising:
   (a) an elongated housing having an opening in the wall thereof;
   (b) two spaced apart fixed plates secured to said housing and each said fixed plate having guide slot means;
   (c) a drive plate adjacent to each said fixed plate and movable with respect to said housing;
   (d) drive means to move said drive plate;
   (e) a cutting assembly mounted in said housing and having guide means engaging said guide slot means and said drive plate to extend and retract said assembly through said opening of said housing in response to the movement of said drive plate;
   (f) each said guide slot of said fixed plate having:
      (i) a first and a second spaced apart slot, each slot having a first long section parallel to the long section of the other slot which makes a selected angle $\beta$ with respect to the direction of the longitudinal axis of said housing;
      (ii) each said spaced apart slot having legs which are nonparallel to each other.

9. An apparatus as defined in claim 8 in which the angle $\beta$ is between about 70° and 45° and in which the upper leg of the upper of said spaced apart slots makes a right angle with the long section thereof.

10. An apparatus for drilling a sidewall core from a borehole comprising:
   an elongated housing having an opening in the wall thereof;
   a fixed plate secured to said housing having guide slot means;
   said guide slot means comprising first and second spaced apart slots, each slot having a first long section parallel to a long section of the other slot which makes a selected angle $\beta$ with respect to the direction of the longitudinal axis of said housing;
   each said spaced apart slot having legs which are nonparallel;
   a drive plate adjacent to said fixed plate and movable with respect to said housing;
   drive means to move said drive plate; and
   a cutting assembly mounted in said housing and having guide means engaging said guide slot means and said drive plate to extend and retract said assembly through said opening of said housing in response to the movement of said drive plate.

* * * * *